US007467954B2

(12) United States Patent
Shiu

(10) Patent No.: US 7,467,954 B2
(45) Date of Patent: Dec. 23, 2008

(54) ELECTRICAL CONNECTOR ASSEMBLY

(75) Inventor: Guo-Jiun Shiu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,204

(22) Filed: Dec. 26, 2007

(65) Prior Publication Data

US 2008/0153349 A1 Jun. 26, 2008

(51) Int. Cl.
*H01R 12/00* (2006.01)

(52) U.S. Cl. ..... 439/74; 439/660

(58) Field of Classification Search ..... 439/74, 439/570, 660, 848
See application file for complete search history.

(56) References Cited

U.S. PATENT DOCUMENTS

| | | | | |
|---|---|---|---|---|
| 6,296,524 | B1 * | 10/2001 | Goto | 439/660 |
| 6,645,005 | B2 | 11/2003 | Wu | |
| 6,881,075 | B2 * | 4/2005 | Huang et al. | 439/74 |
| 7,195,495 | B2 * | 3/2007 | Takano et al. | 439/74 |
| 7,278,861 | B2 * | 10/2007 | Kishi et al. | 439/74 |
| 7,320,606 | B2 * | 1/2008 | Midorikawa | 439/74 |

* cited by examiner

*Primary Examiner*—Thanh-Tam T Le
(74) *Attorney, Agent, or Firm*—Wei Te Chung

(57) ABSTRACT

An electrical connector assembly comprises a receptacle connector and a plug connector engaged with said receptacle connector. Said receptacle connector comprises a first housing having a pair of longitudinal sidewalls, a plurality of first contacts retained in said sidewalls and at least one pair of first metal ears attached on said sidewalls. Said plug connector includes at least one pair of second metal ears engaged with said first metal ear. The first metal ear has a identical structure with said first contact and engages with the second metal ear so that the first metal ear and the first contact can share a same mound which reduces the cost.

9 Claims, 5 Drawing Sheets

ELECTRICAL CONNECTOR ASSEMBLY

BACKGROUND OF THE INVENTION

1. Field of the Invention

The present invention relates to an electrical connector assembly, and more particularly to an electrical connector assembly connecting two printed circuit boards.

2. Description of Related Art

U.S. Pat. No. 6,645,005 discloses an electrical connector assembly including a plug connector and a receptacle connector engaged with each other. Both said plug connector and receptacle connector has a housing, a plurality of contacts and a pair of metal ears attached on two opposite ends of the housing. The metal ears include a pair of first metal ears and a pair of second metal ears respectively assembled on said plug connector and receptacle connector. The first metal ear of the plug connector has a mating arm extending upwardly with a protrusion on a surface thereon. Said second metal ear has a mating latch with a receiving portion on a surface thereon. Said protrusion of the first metal ear engages with said receiving portion of the second metal ear, which enhances the mating force between said plug connector and receptacle connector.

However, said metal ears and contacts have different structures that requires to found different moulds respectively and different assembly processes, and this makes the manufacture process complicated with a high cost. Moreover, each of the metal ears is attached on an exterior surface of an endwall of the housing, said mating arm and the metal latch are flexible along said longitudinal housing, as a result, the metal arm and metal latch will be curved easily apart from said housing if any outer force beyond expectation put on either said plug connector or said receptacle connector during the mating process between said first metal ear and second metal ear. So it is necessary to provide a new electrical connector assembly to solve the problems above.

SUMMARY OF THE INVENTION

Accordingly, one object of the present invention is to provide an electrical connector assembly which reduces the manufacture cost efficiently.

Another object of the present invention is to provide an electrical connector assembly having an enhanced mating force which makes a firm connection.

In order to achieve above-mentioned objects, an electrical connector assembly is provided and it comprises a receptacle connector and a plug connector engaged with said receptacle connector. Said receptacle connector comprises a longitudinal first housing having a pair of sidewalls, a plurality of first contacts retained in said sidewalls and at least one pair of first metal ears attached on said sidewalls. Said plug connector comprises a second housing having a pair of longitudinal sidewalls, a plurality of second contacts retained in said second housing mating with said first contacts and at least one pair of second metal ear engaged with said first metal ear. The first metal ear has a identical structure with said first contact, and said first metal ear includes a mating arm having a first locking portion and a soldering leg, the second metal ear has a second locking portion engaging with said first locking portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
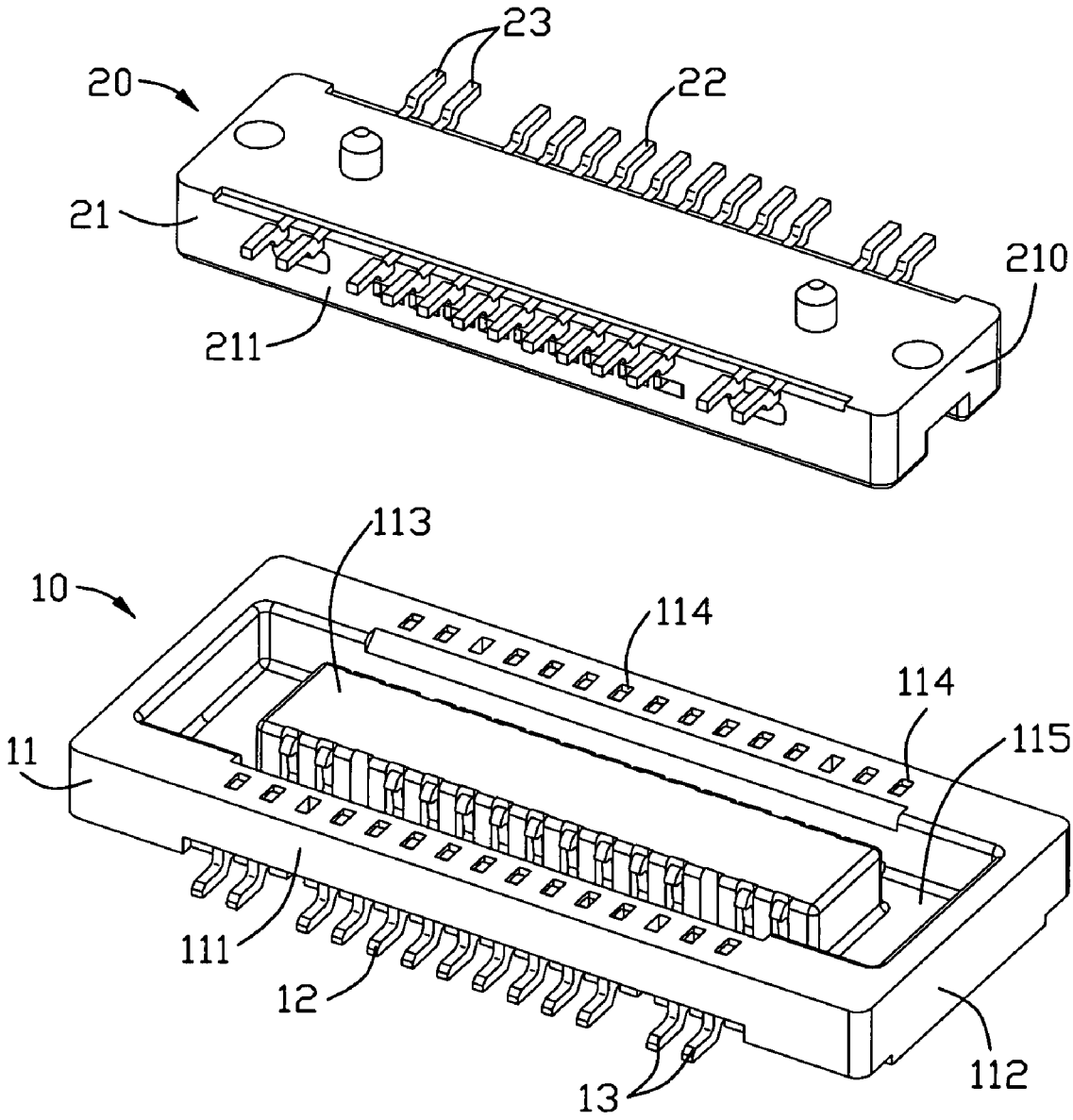
FIG. 1 is a perspective view of an electrical connector assembly, in accordance with the present invention, particularly showing a plug connector and a receptacle connector before mating each other.

Reference will now be made to the drawing figures to describe the preferred embodiment of the present invention in detail.

Referring to FIG. 1, an electrical connector assembly in accordance with the present invention is provided. The electrical connector assembly comprises a receptacle connector (10) and a plug connector (20) mating with said plug connector (10). Said receptacle connector (10) and said plug connector (20) are mounted on two printed circuit boards respectively.

Figure 2:
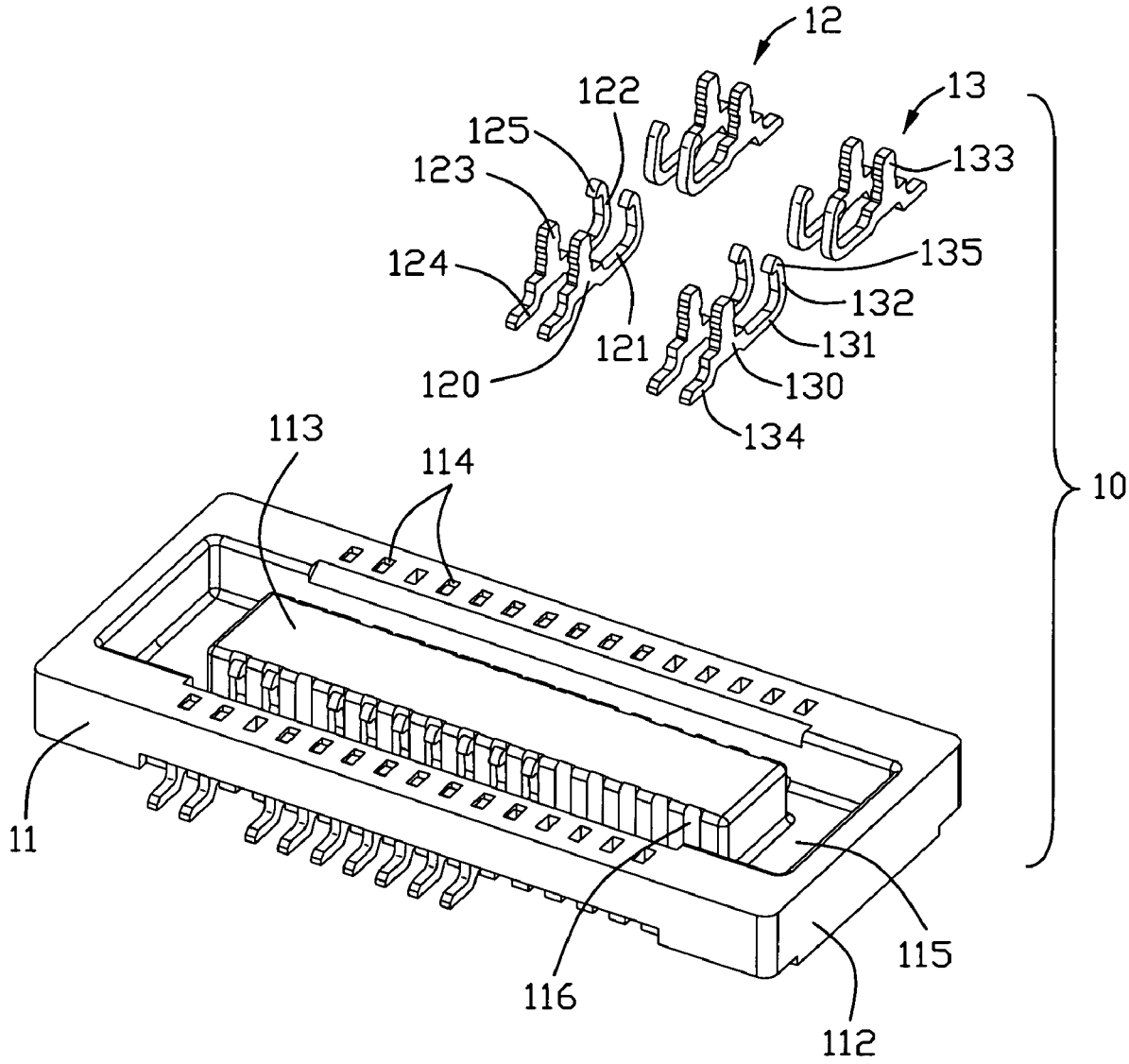
FIG. 2 is an exploded view of the receptacle connector shown in FIG. 1, with several contacts and metal ears unassembled, showing a first metal ear having a identical structure with a first contact.
Figure 5:
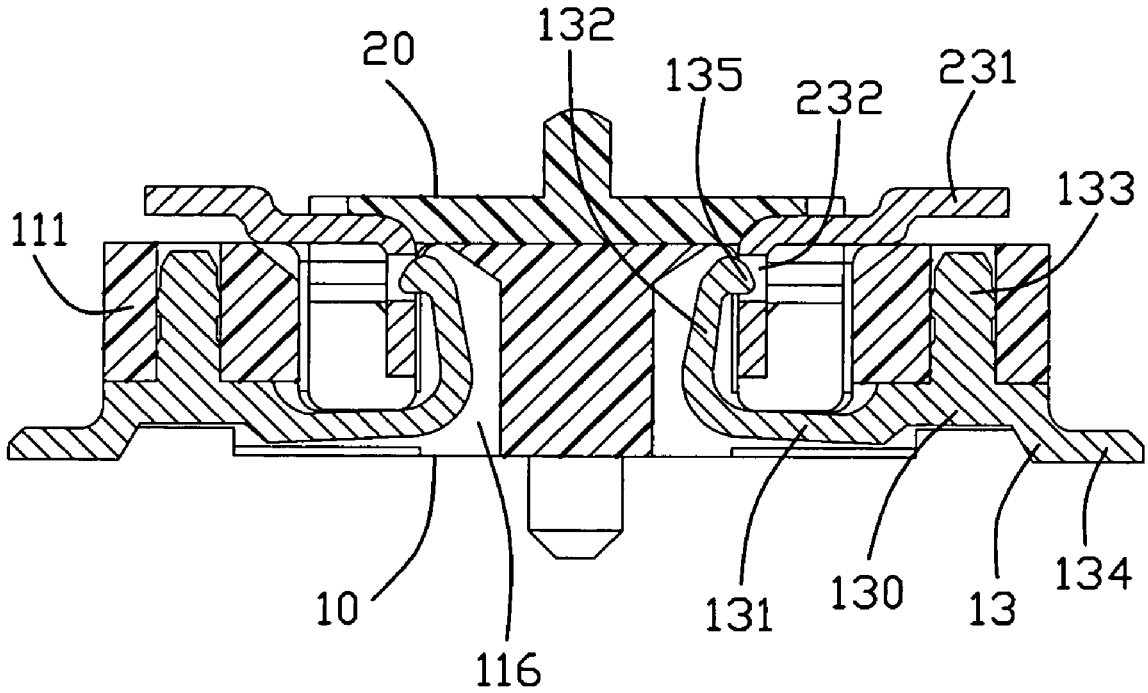
FIG. 5 is a cross-section view of the electrical connector assembly taken along line 5-5 of FIG. 4.

Referring to FIGS. 2 and 5, the receptacle connector (10) includes a first housing (11), a plurality of first contacts (12) retained in said first housing (11) and a pair of first metal ear (13) assembled on two sides of the first housing (11). Said first housing (11) has a longitudinal insulating body with a closed peripheral wall. The peripheral wall comprises a pair of sidewalls (111) and a pair of endwalls (112) connected with said sidewalls (111). Each sidewall (111) has a plurality of receiving holes (114) running through the sidewall (111) from a top surface to a bottom surface of the sidewall (111). The endwalls (112) connected with said sidewalls (111) which defines a receiving space (115) with a projecting island (113) therein. Said projecting island (113) projects from a bottom of said first housing (11) with a plurality of first passageways (116) on two sides thereon. Said first passageways (116) run through with said receiving space (115) for receiving said first contacts (12). Each first contact (12) includes a base portion (120), a connected arm (121) extending toward said projecting island (113), a spring mating arm (122) formed on an end of said connected arm (121), a holding portion (123) extending upwardly from the base portion (120) and a soldering leg (124) extending out of the first housing (11) from said base portion (120) for soldering on a printed circuit board (not shown). Said base portion (120) and said connected arm (121) are formed in a horizontal direction approximately. The connected arm (121) lies on the bottom of the first housing (11) for connecting said base portion (120) and said spring mating arm (122). The spring mating arm (122) is received in said first passageway (116) with a protrusion (125) formed on a free tip end thereon.

The first meal ear (13) is retained in said first passageway (116) and arranged in a same line with said first contact (12) on the sidewall (111) of the first housing (11). Said first metal ears (13) are retained on two sides of said first contacts (12) not only for soldering on the printed circuit board (not shown) but also for engaging with the plug connector (20). Said first metal ear (13) has a identical structure with said first contact (12) which enables the first metal ear (13) to share a identical mound with said first contact (12) during the manufacture. The first metal ear (13) also has a base portion (130), a connected arm (131), a spring mating arm (132), a holding portion (133) and a soldering leg (134). Said base portion (130) of the first metal ear (13) lies under the sidewall (111). The soldering leg (134) of the first metal ear (13) is arranged in a same line with said soldering leg (124) of the first contact (12). Said holding portion (133) of the first metal ear (13) is retained in said receiving hole (114) of the sidewall (111). The spring mating arm (132) of the first metal ear (13) has a protrusion (135) on a tip end thereof which defines a first locking portion in order to engage with a second metal ear (23) of plug connector (20).

Figure 3:
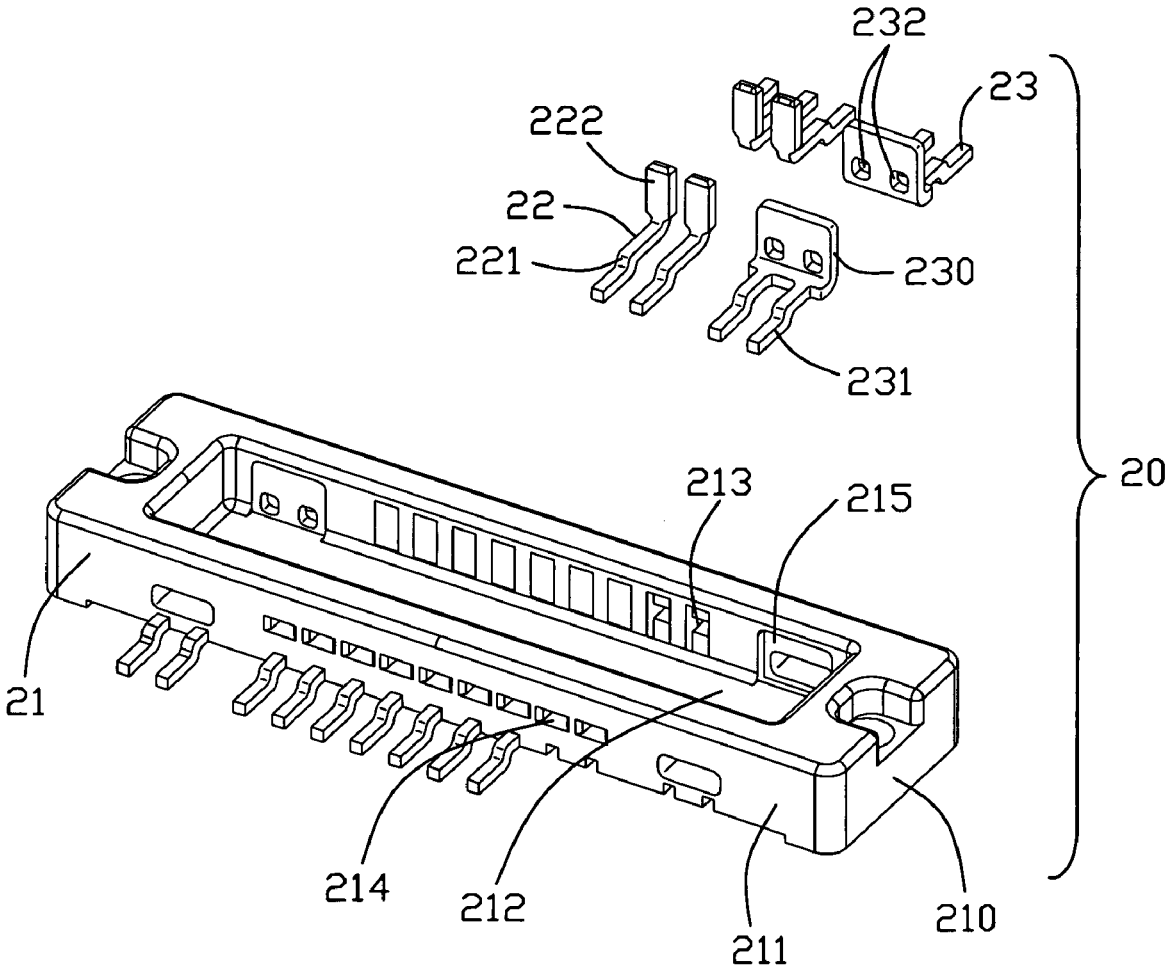
FIG. 3 is an exploded view of the plug connector shown in FIG. 1, with several second contacts and second metal ears unassembled.
Figure 4:
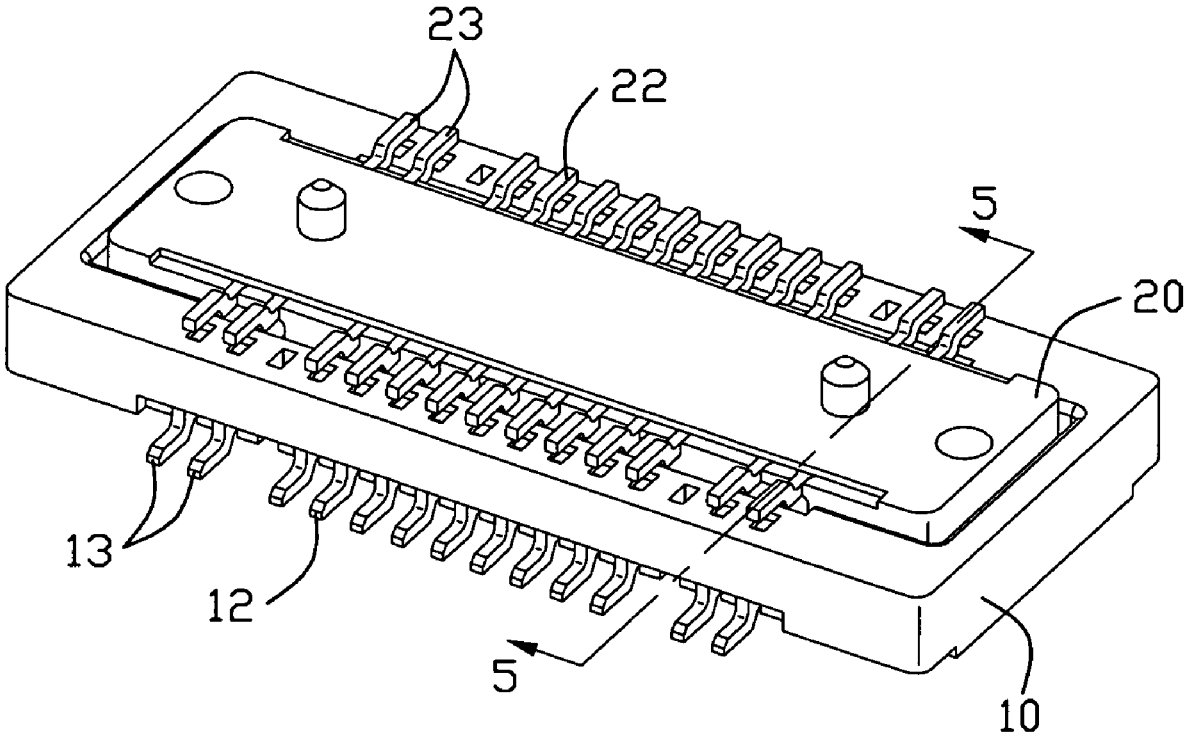
FIG. 4 is an assembled, perspective view of an electrical connector assembly shown in FIG. 1, showing the whole view of the plug connector and the receptacle connector after mating each other.

Referring to FIGS. 3 and 5, the plug connector (20) includes a second housing (21), a plurality of second contacts (22) received in said second housing (21) and two pairs of second metal ears (23) retained on two sides of the second housing (21). Said second housing (21) has a pair of sidewalls (211) and a pair of endwalls (210) which defines a receiving room (212) receiving said projecting island (113) of the receptacle connector (10). A plurality of second passageways (213) and receiving grooves (215) are formed on an inner surface of said sidewall (211) for receiving said second contacts (22) and said second metal ears (23) respectively. Each second passageway (213) runs through said sidewall (211) outwardly which defines an aperture (214) on an outer surface of the sidewall (211). Each second contact (22) is formed in L-shape which includes a horizontal portion (221) and a vertical portion (222). Said horizontal portion (221) extends out of said second housing (21) from a bottom of the sidewall (211) for soldering on a printed circuit board (not shown). Said vertical portion (222) is wider than said horizontal portion (221) in transverse width and is received in said second passageway (213) mating with said spring mating arm (122) of the first contact (12). The second metal ear (23) is curved in L-shape having a vertical mating tab (230) and a pair of soldering pads (231) extending out of the sidewall (211) from a bottom of the vertical mating tab (230). Said vertical mating tab (230) is received in said receiving groove (215) with a pair of concaves (232) on a surface thereon. The concaves (232) defines a second locking portion engaging with said protrusions (135) of said first metal ear (13). As referring to FIG. 3, said second metal ear (23) has a similar shape with said second contact (22), and one second metal ear (23) mates with two first metal ears.

Referring to FIG 5, when the receptacle connector (10) assembles with said plug connector (20), said first metal ear (13) mates with said second metal ear (23) without electrical connection therebetween while the first contact (12) mates with the second contact (22) electrically. Said the first locking portion of the first metal ear (13) engages with said second locking portion of the second metal ear (23) by said protrusion (135) engaging with said concave (232) which enhances the mating force between the receptacle connector (10) and the plug connector (20).

However, while the preferred embodiment of the invention has been shown and described, it will apparent to those skilled in the art that changes and modifications may be made therein without departing from the spirit of the invention, the scope of which is defined by the appended claims.

What is claimed is:

1. An electrical connector assembly comprising:

a receptacle connector comprising a longitudinal first housing having a pair of sidewalls, a plurality of first contacts retained in said sidewalls and at least one pair of first metal ears attached on said sidewalls respectively;

a plug connector engageable with said receptacle connector and comprising a second housing having a pair of longitudinal sidewalls, a plurality of second contacts retained in said second housing for mating with said first contacts, and second metal ears engageable with said first metal ears; wherein each first metal ear has an identical structure with each said first contact and includes a mating arm having a first locking portion and a soldering leg, said second metal ear has a second locking portion engageable with said first locking portion without electrical connection therebetween, each second metal ear mates with two first metal ears; and wherein the first locking portion of the first metal ear is a protrusion while the second locking portion of the second metal ear is a concave engaging with said protrusion.

2. The electrical connector assembly as claimed in claim 1, wherein said first metal ear farther includes a base portion, a connected arm extending toward a inner side of the first housing from said base portion and a holding portion extending upwardly from said base portion, said connected arm connects with the base portion and the mating arm.

3. The electrical connector assembly as claimed in claim 2, wherein said second metal ear is attached on said sidewall of said second housing and formed in L-shape.

4. The electrical connector assembly as claimed in claim 3, wherein said L-shaped second metal ear has a vertical tab and a pair of soldering pads extending from a bottom edge of said vertical tab, said soldering pads extend parallel out of the second housing.

5. The electrical connector assembly as claimed in claim 4, wherein each said second contact is formed in L-shape having a horizontal portion and a vertical portion, said vertical portion is wider than horizontal portion in transverse width.

6. A receptacle connector for mating with a mateable plug connector comprising:

a housing having a pair of longitudinal sidewalls defining a receiving space;

a plurality of contacts attached on said sidewalls, each contact having aspring mating arm extending into said receiving space;

at least one pair of first metal ears retained in said sidewalls on two sides of said contacts along a longitudinal direction each first metal ear having an identical structure with said contact; and comprising a spring mating arm having a first locking portion at a tip end thereof, said at least one pair of metal ears mated with a metal ear of said mateable plug connector in two on one relation without electrical connection therebetween wherein the first locking portion of the first metal ear is a protrusion while a second locking portion of the second metal ear is a concave engaging with said protrusion.

7. The receptacle connector as claimed in claim 6, wherein the housing has a projecting island projecting from a bottom of said housing in a middle of said receiving space, the projecting island has a plurality of passageways on two sides thereon receiving said contacts.

8. The receptacle connector as claimed in claim 7, wherein said sidewall of the housing has a plurality of receiving holes running through the sidewall from a top surface to a bottom surface of the sidewall.

9. The receptacle connector as claimed in claim 8, wherein said contact has a base portion lying under said sidewall and a holding portion extending upwardly from said base portion and received in said receiving hole.

* * * * *